US006695438B2

(12) United States Patent
Okazawa

(10) Patent No.: US 6,695,438 B2
(45) Date of Patent: Feb. 24, 2004

(54) LIQUID JETTING HEAD

(75) Inventor: Noriaki Okazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/253,905

(22) Filed: Sep. 25, 2002

(65) Prior Publication Data

US 2003/0067514 A1 Apr. 10, 2003

(30) Foreign Application Priority Data

Sep. 26, 2001 (JP) ..... P2001-293248
Sep. 12, 2002 (JP) ..... P2002-266288

(51) Int. Cl.[7] ..... B41J 2/045
(52) U.S. Cl. ..... 347/70
(58) Field of Search ..... 347/68–72

(56) References Cited

U.S. PATENT DOCUMENTS 6,332,671 B1 * 12/2001 Takahashi et al. ..... 347/68
6,361,160 B2 * 3/2002 Feinn et al. ..... 347/87

FOREIGN PATENT DOCUMENTS

JP 10-278263 10/1998

* cited by examiner

*Primary Examiner*—Judy Nguyen
(74) *Attorney, Agent, or Firm*—Sughrue Mion, PLLC

(57) ABSTRACT

A conductive supporting plate is laminated on an elastic film. The conductive supporting plate is partly removed to form an elastic region in which first island portions and second island portions are remained on the elastic film while being electrically insulated from each other. A head case is formed with a chamber which forms an opening at a first end face joined to the supporting plate. In a vibrator unit, a plurality of piezoelectric vibrators are arranged on a fixing plate. The piezoelectric vibrators include a pair of non-deformable vibrators and deformable vibrators arranged between the non-deformable vibrators. The vibrator unit is accommodated within the chamber such that each tip end face of the deformable vibrators is abutted onto one of the first island portions, and each tip end face of the non-deformable vibrators is abutted onto one of the second island portions. Each of the second island portions define a first recess at a portion of the elastic region where opposes to corners of the opening at the first end face of the head case, to receive an adhesive used to bond the vibrator unit to the head case and overflowed from the opening.

6 Claims, 8 Drawing Sheets

LIQUID JETTING HEAD

BACKGROUND OF THE INVENTION

The present invention relates to a liquid jetting head enabling to eject liquid in the state of droplet such as an ink jet recording head, a liquid crystal jetting head, a coloring material jetting head, etc., particularly to a head having a vibrator unit provided with a plurality of piezoelectric vibrators.

In the liquid jetting head enabling to eject droplet from a nozzle orifice by generating pressure fluctuation in liquid in a pressure chamber, there is an ink jet recording head discharging ink drops used for an image recording apparatus or the like. Recently, the head is applied for every kind of industrial equipment in view of an advantage that very little liquid can be ejected accurately. For example, the head is applied for a liquid jetting head enabling to eject liquid crystal, a coloring material jetting head enabling to eject coloring material for filter, an electrode material jetting head enabling to eject electrode material becoming an electrode, a bio-organic substance jetting head enabling to eject a bio-organic substance, a micro pipette (a sample jetting head) enabling to eject a very little sample accurately, and so on.

In the various kinds of types of such the liquid jetting head, there is a head having a vibrator unit provided with plural piezoelectric vibrators and discharging ink drop by varying volume of a pressure chamber by deformation of the piezoelectric vibrators. The liquid jetting head is roughly constructed by the vibrator unit, a case having a chamber for storing the vibrator unit, and a channel unit joined to the tip end portion of the case. The channel unit is constructed by: a channel forming substrate having a space to be a pressure chamber and a reservoir; a nozzle plate made of metal formed with plural nozzle orifices; a laminated plate of a metal supporting plate and an elastic film; and an elastic plate having an elastic region. The tip end face of each piezoelectric vibrator is bonded on each island portion formed in the elastic region, and liquid drop is ejected from the nozzle orifice by displacing the island portion by deformation of the piezoelectric vibrator. In this construction, remained adhesive is held at the edge of the supporting plate. For example, overflowing adhesive from gap of the tip end face of the piezoelectric vibrator and the island portion is held at a corner portion between the tip end face of the piezoelectric vibrator and the island portion by surface tension of the adhesive. Such a configuration is disclosed in Japanese Patent Publication No. 10-278263A, for example.

For one type of the vibrator unit in which piezoelectric vibrators are fixed on a fixing plate in a cantilevered manner that free end portions of the vibrators are protruded from one face of the fixing plate, the one face of the fixing plate is bonded to an inner wall of the chamber for accommodating the vibrator unit to be fixed within the case.

In such a construction, if the applied quantity of the adhesive for bonding the vibrator unit to the case is excessive, the remained adhesive overflows from the chamber to the elastic plate side. In this case, although it is considered that overflowing adhesive is held at the edge of the supporting plate, the adhesive overflows easily because quantity enabling to hold is very little. The elastic film is hardened by the overflowing adhesive so as to cause fault such as damage of elasticity thereof.

FIG. 8 shows a configuration in which a concave is provided in the elastic plate to hold an adhesive therein in view of the above situation.

In this example, an adhesive holding concave 2 is formed in the vicinity of an elastic region 5 so as to face a corner portion 1 of an opening of an vibrator chamber, by removing a part of a supporting plate 4 so as to remain an elastic film 3. There is formed a partition 4*a* between the adhesive holding concave 2 and the elastic region 5. A part of piezoelectric vibrators 6, that is, a dummy vibrator 6*a* which is not involved in the liquid ejection is bonded to the partition 4*a*.

The piezoelectric vibrator 6 is produced by laminating a common electrode and a drive electrode alternately sandwiching a piezoelectric material so as to deform in accordance with potential difference application. For example, a potential of the common electrode is set as the lowest potential near the ground potential and a drive signal is applied to the drive electrode to applied the potential difference. In a normal condition, the drive signal is provided as an intermediate potential so that the potential can be risen or fallen from the intermediate potential as a reference potential.

Incidentally, insulating resistance of the piezoelectric material possibly falls by long use of the piezoelectric vibrator 6. When the insulation fault generates, the drive electrode of the piezoelectric vibrator 6 (driving vibrator 6*b*) can not keep the intermediate potential so as to fall the lowest potential being potential of the common electrode. In this case, when high potential driving signal is supplied to eject liquid drop, the volume and the speed of expansion and contraction of the piezoelectric vibrator 6*b* become large inordinately, so that liquid drop is ejected unexpectedly.

In order to prevent such an accidental ejection, it is considered that constant bias potential higher than the lowest potential and lower than intermediate potential is applied to the common electrode. In this case, since the potential of the drive electrode falls to at least the bias potential even if insulation fault generates, the accidental liquid drop ejection can be prevented.

However, when the bias potential is applied to the common electrode, there is probability that the bias potential passes through the tip end face of the piezoelectric vibrator 6 and leaks to a nozzle plate. That is, the supporting plate 4 charges to bias potential through the partition 4*a* via the dummy vibrator 6*a*. Further, since an introducing port through which liquid flows is formed at the supporting plate 4, liquid charges to bias potential and also the nozzle plate becomes bias potential as the result in the case of the liquid is conductive. In order to prevent charge of the liquid, the nozzle plate is adjusted to ground potential (frame ground). Therefore, short-circuit possibly occurs when the nozzle plate charges.

SUMMARY OF THE INVENTION

It is therefore an object of the present invention to provide a structure of liquid jetting head for preventing leakage of bias potential and preventing fault caused by remained adhesive.

In order to achieve the above object, according to the present invention, there is provided a liquid jetting head, comprising:

an elastic plate, including an elastic film and a conductive supporting plate laminated on the elastic film, the conductive supporting plate being partly removed to form an elastic region in which first island portions and second island portions are remained on the elastic film while being electically insulated from each other;

a head case, formed with a chamber which forms an opening at a first end face joined to the supporting plate; and a vibrator unit, in which a plurality of piezoelectric vibrators are arranged on a fixing plate, the piezoelectric vibrators including a pair of non-deformable vibrators and deformable vibrators arranged between the non-deformable vibrators, wherein:

the vibrator unit is accommodated within the chamber such that each tip end face of the deformable vibrators is abutted onto one of the first island portions, and each tip end face of the non-deformable vibrators is abutted onto one of the second island portions; and each of the second island portions define a first recess at a portion of the elastic region where opposes to corners of the opening at the first end face of the head case, to receive an adhesive used to bond the vibrator unit to the head case and overflowed from the opening.

In this configuration, the second island portion is placed on the insulative elastic film so as to be insulated from other members, the bias potential applied to the non-deformable vibrator will not leak through the supporting plate. Accordingly, there can be avoided the charging of liquid ejected from nozzle orifices, and the short-circuit to the frame ground. Further, even if an excessive adhesive is overflowed from the chamber, since the adhesive can be held within the first recess, the adhesive is prevented from overflowing to a part of the elastic region at which the first island portions are provided. Therefore, operation fault of the elastic plate can be avoided.

Preferably, a first gap is formed between an edge of the elastic region and each of the second island portions. A width of the first gap is so determined that the adhesive is held therein due to surface tension of the adhesive.

In this configuration, adhesive can be held in the first recess with a simple structure.

Here, it is preferable that each of the second island portions includes a branch part which defines a second recess communicated with the first recess via the first gap. A second gap is formed between the edge of the elastic region and the branch part. A width of the second gap is so determined that the adhesive is held therein due to surface tension of the adhesive.

In this configuration, even if the adhesive overflowed from the opening is more than the capacity of the first recess, the second recess can receive the excessive adhesive.

Preferably, the supporting plate is comprised of a stainless steel plate, and the head case is comprised of an insulative material.

In this case, heat radiating property and electrical insulation can be attained in the supporting plate.

Alternatively, it is preferable that the fixing plate is comprised of an insulative material, and the head case is comprised of a conductive material.

In this case, the design freedom is improved because the head case can be used as a ground electrode.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the invention will be described below with reference to the accompanying drawings. The following description is referred to an ink jet recording head (hereinafter, simply referred as a recording head) which is a kind of a liquid jetting head. The ink jet recording head is incorporated in an image recording apparatus such as a printer, a plotter, a facsimile, and the like, to eject ink drops from a nozzle orifice.

Figure 1:
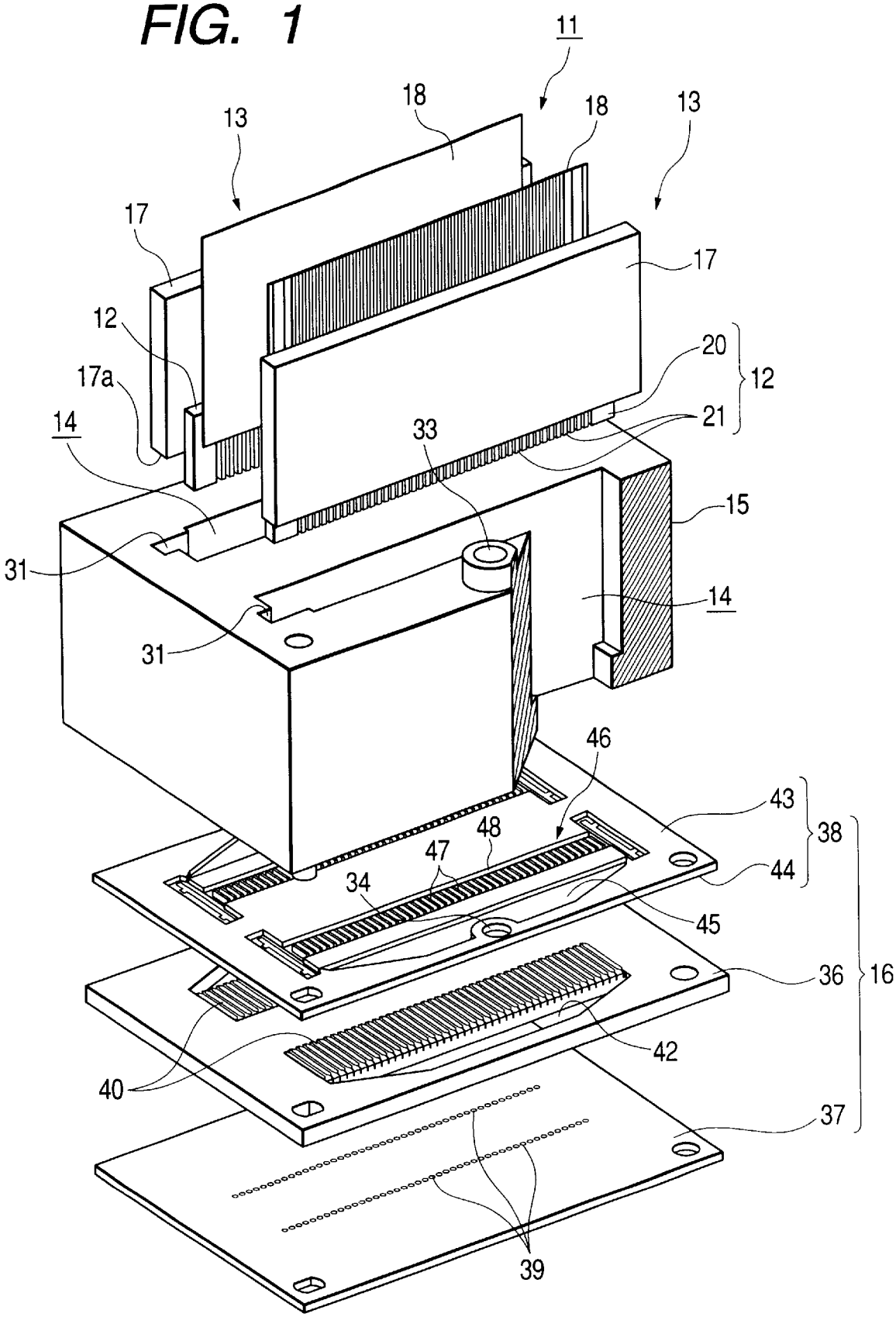
FIG. 1 is a decomposed perspective view of a liquid jetting head according to one embodiment of the invention.

As shown in FIG. 1, a recording head 11 comprises a pair of vibrator units 13, a resin case 15 for storing the vibrator units 13, a channel unit 16 joined to the case 15.

Figure 2:
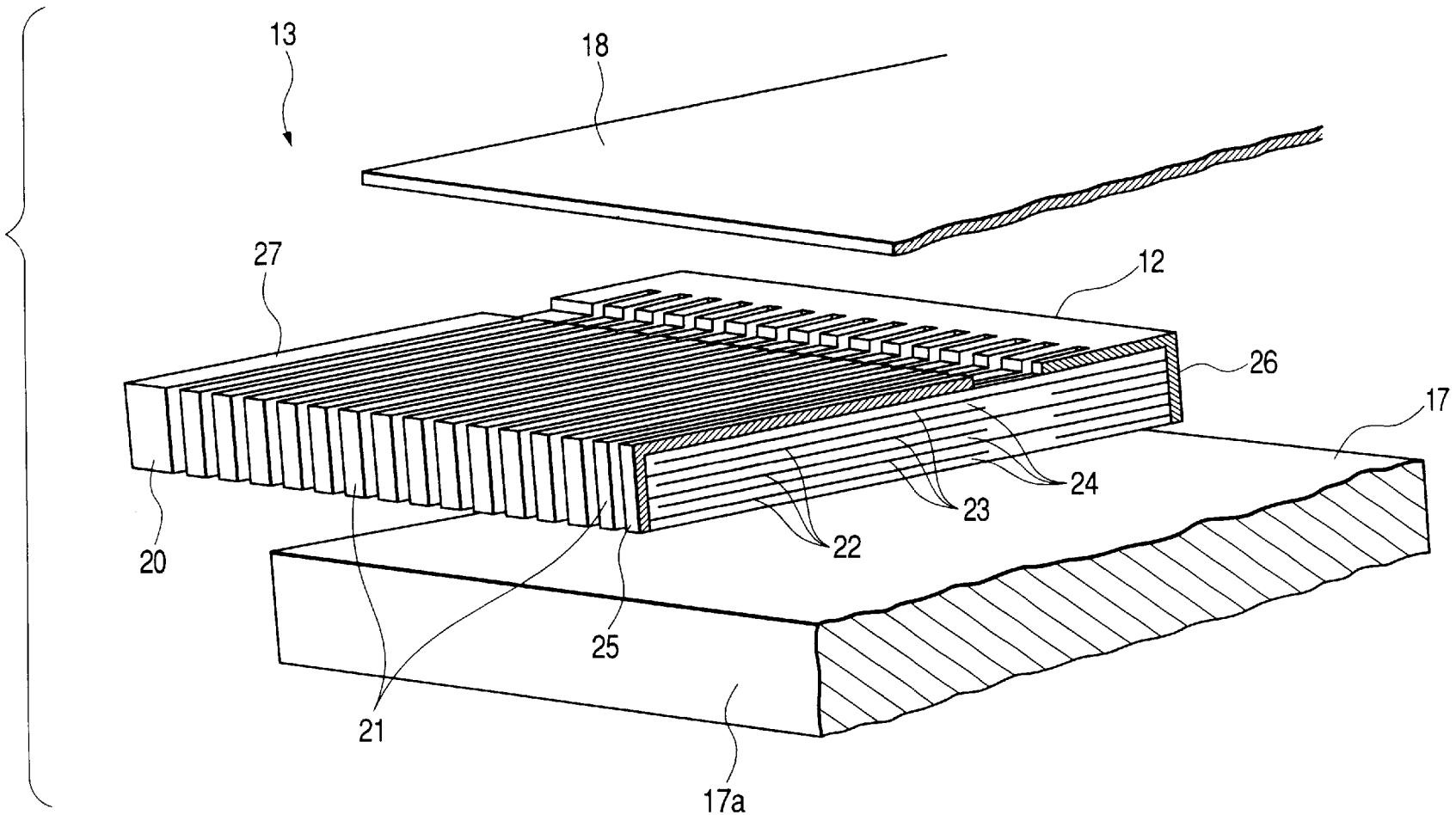
FIG. 2 is a decomposed perspective view of a vibrator unit in the liquid jetting head.

As shown in FIG. 2, the vibrator unit 13 comprises: a vibrator assembly 12; a fixing plate 17 on which the vibrator assembly 12 is bonded; and a flexible cable 18 for supplying bias potential and driving signal to the vibrator assembly 12. The vibrator assembly 12 is constructed by a pair of dummy vibrators 20 placed at both side ends of the assembly and plural driving vibrators 21 arranged between these dummy vibrators 20. The driving vibrator 21 is a piezoelectric vibrator expanding and contracting by supply of driving signal and is pectinated so as to have very thin width of about 50 to 100 $\mu$m so that vibrators of 96 pieces are provided in total. The dummy vibrator 20 is a piezoelectric vibrator not expanding and contracting, has sufficiently wider width than the driving vibrator 21 to serve also as a protector which protects the driving vibrator 21 from shock or the like, and also as a guide member for positioning the vibrator unit 13 to the predetermined position.

The driving vibrator 21 is a laminating type piezoelectric vibrator laminating drive electrodes 22 and common electrodes 23 alternately while sandwiching a piezoelectric material 24. The piezoelectric vibrator is of a longitudinal vibration type enabling to expand and contract to directions perpendicular to the laminating direction. At outer side face of each driving vibrator 21, a driving external electrode 25 and a common external electrode 26 are formed, and driving signal is supplied through these external electrodes 25 and 26. That is, driving signal is supplied to the drive electrode 22 through the external electrodes 25, and bias potential is supplied to the common electrode 23 through the common external electrode 26.

When the driving signal is supplied to the drive electrode 22, voltage corresponding to difference between potential of the driving signal and the bias potential is applied to the piezoelectric material 24. The piezoelectric material 24 deforms corresponding to magnitude of the applied voltage, and the driving vibrator 21 expands or contracts.

Although the structure of the dummy vibrator 20 is similar as the driving vibrator 21, it differs from the driving vibrator that supplying source of potential is not connected to the corresponding electrode 27 to the drive electrode 22 and driving external electrode 25. That is, in the dummy vibrator 20, the electrode 27 serves as a floating electrode (a floating electrode 27, hereafter) and conductor of the flexible cable 18 is not connected. On the other hand, a conductor for supplying the bias potential is connected because each driving vibrator 21 and the dummy vibrator 20 are made continuous through the common external electrode 26. Although the floating electrode 27 is joined to a fixed island portion 49 and an auxiliary fixed island portion 51 (see FIG. 3) described later through adhesive layer, these fixed island portion 49 and auxiliary fixed island portion 51 are electrically insulated to another member. Because of that, potential difference applied to each piezoelectric material 24 constructing the dummy vibrator 20 becomes constant so that the dummy vibrator 20 does not expand or contract.

For the fixing plate 17, a plate-shaped member having rigidity enabling to receive reaction from the piezoelectric vibrators and superior in heat radiation is preferably used. For example, it is constructed by metal plate member. In the embodiment, it is constructed by stainless steel plate of 1 mm thickness. Each of the vibrators 20 and 21 is fixed on the fixing plate 17 in a cantilevered manner. Namely, one end portion of each vibrators 20 and 21 is joined onto the fixing plate 17 such that the other end portion thereof is projected from an end face 17*a* of the fixing plate 17 as a free end portion. The flexible cable 18 is provided on a face in the fixed end side of the vibrators 20 and 21 opposing to the face joined to the fixing plate to be electrically connected to the vibrators 20 and 21.

The case 15 has a rectangular block-shaped appearance. In this embodiment, the case 15 is made of epoxy resin which is a kind of thermosetting resin to avoid the charging of the channel unit 16 (elastic plate 38). That is, since the thermosetting resin such as epoxy resin has insulating property, the fixing plate 17 and the elastic plate 38 are insulated so that the charging of the channel unit 16 can be avoided. In addition, since this kind of thermosetting resin has greater stiffness than the general resin, vibration generated from the driving vibrator 21 can be sufficiently received. Further, since this kind of thermosetting resin has a smaller coefficient of linear expansion, deformation caused by environmental temperature change can be suppressed.

Figure 4:
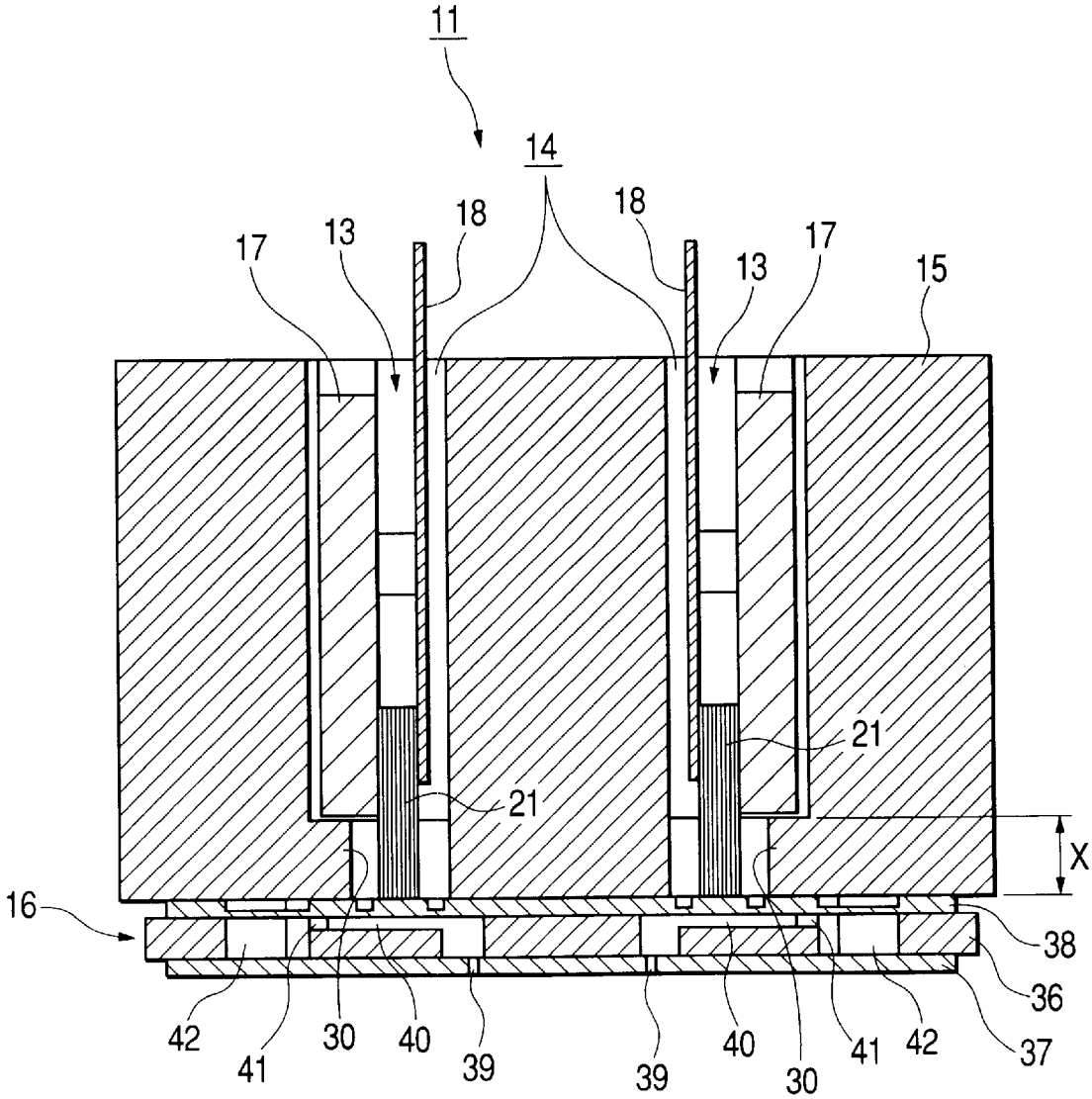
FIG. 4 is a sectional view of the liquid jetting head.

The channel unit 16 is joined onto one end face of the case 15, while the other end face opposing to the one end face serves as a mounting face to be mounted on a carriage assembly. The chamber 14 penetrates the case 15 so as to communicate these end faces. The size of the chamber 14 is so determined that the vibrator unit 13 can be fitted thereinto. In the channel unit-side of the chamber 14, as shown in FIG. 4, a step 30 is formed so that the end face 17*a* of the fixing plate 17 is bonded thereon. Here, a distance between the end face 17*a* and the channel unit-side end face of the case 15, that is, the height X of the step 30 is slight shorter than the length of the free end portions of the driving vibrators 21. Accordingly, when the tip end face of the vibrators 20 and 21 are abutted onto the island portions (movable island portions 47, etc., described later; see FIG. 6), a very narrow gap is formed between the end face 17*a* and the step 30. An adhesive is introduced into the gap by capillary force to bond the vibrator unit 13 to the case 15.

As shown in FIG. 1, guide grooves 31 are formed on both longitudinal side faces of the chamber 14 to guide both side edges of the fixing plate 17. Each guide groove 31 is formed by partly recessing the side faces of the chamber 14. The width of each guide groove 31 is so determined as to substantially match with the thickness of the fixing plate 17.

Figure 5:
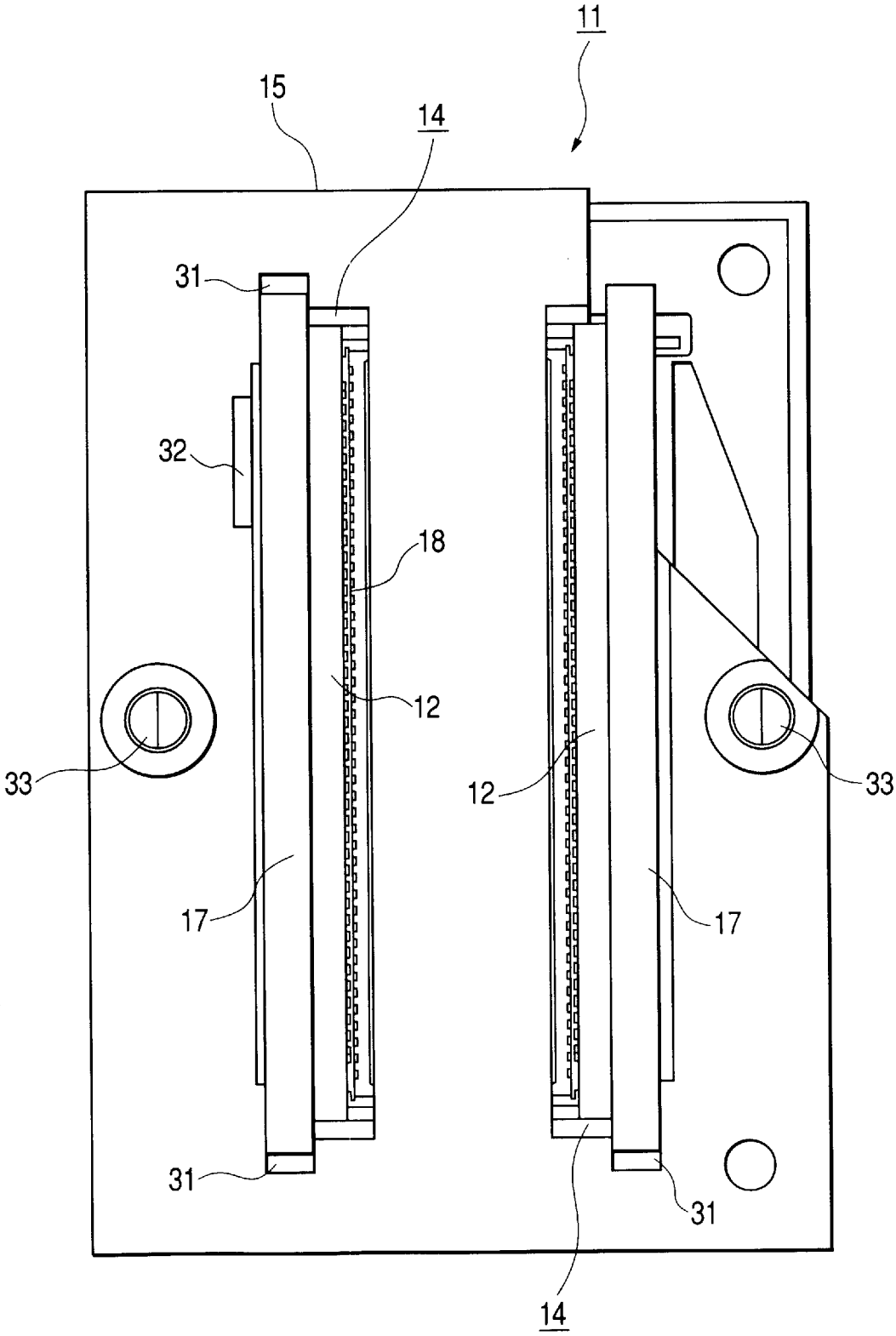
FIG. 5 is a plan view of the liquid jetting head in which a part of a case is cut out.

As shown in FIG. 5, an adhesive injection port 32 is formed so as to face a region at which the fixing plate 17, and is opened at the carriage-side end face of the case 15. The adhesive injection port 32 is formed by partly recessing a side face of the chamber 14 on which the fixing plate 17 is bonded. In addition, the case 15 is provided with an ink supply passage 33 for leading ink from an ink cartridge (not shown) to the channel unit 16. The ink supply passage 33 is so formed as to penetrate the case 15 in the vicinity of the chamber 14.

To form the channel unit 16, a nozzle plate 37 is placed to one main face of a channel forming substrate 36, and an elastic plate 38 is placed to the other main face of the channel forming substrate 36. The laminated members are integrated by bonding or the like. The nozzle plate 37 is a thin stainless steel plate in which nozzle orifices 39 are formed and arranged with a pitch corresponding to the dot recording density. In this embodiment, 96 nozzle orifices are arranged with a pitch of 180 dpi to form a nozzle row. The nozzle plate 37 is electrically connected to the frame ground to avoid the charging of ink drops. In the channel forming substrate 36, spaces to be pressure chambers 40 and ink supply ports 41 (see FIG. 4) are formed in association with the respective nozzle orifices 39, and spaces to be reservoirs 42 are formed in association with the respective nozzle rows. In this embodiment, the channel forming substrate 36 is fabricated by etching a silicon wafer.

Each pressure chamber 40 is a chamber elongated in a direction perpendicular to the extending direction of the nozzle row, and separated from adjacent chambers by partition walls. Each ink supply port 41 is also formed by the partition walls as a narrowed channel. Each reservoir 42 is communicated with the respective pressure chambers 40 via the respective ink supply ports 41, and communicated with the ink cartridge (not shown) via the ink supply passage 33. Accordingly, each reservoir 42 serves as a chamber for storing ink supplied from the ink cartridge to the respective pressure chambers 40.

Figure 3:
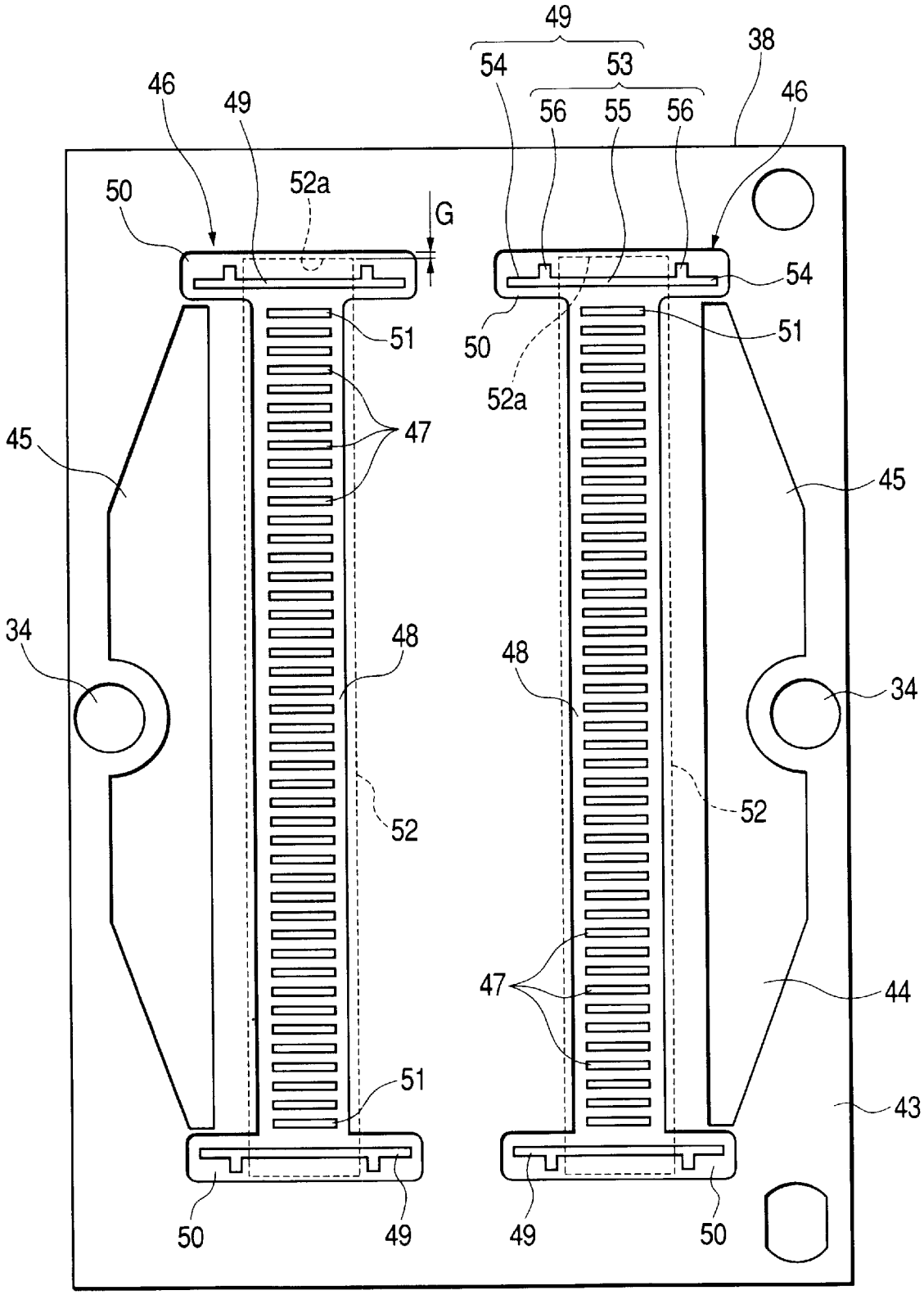
FIG. 3 is a plan view of an elastic plate in the liquid jetting head.

To form the elastic plate 38, an insulative elastic film 44 is laminated on a conductive supporting plate 43. In this embodiment, a metal plate is used for the supporting plate 43, more specifically, a stainless steel plate is used. This is because the material has preservation, is easy to work, and is low price. For the elastic film 44, resin film is used, more specifically, a film made of PPS (polyphenylene sulphide) is used. As shown in FIG. 3, in the elastic plate 38, a compliance region 45 and an elastic region 46 are formed by removing the supporting plate 43 partly so as to remain the elastic film 44 by etching process and the like. The compliance region 45 is a part sealing one opening face of the space to be each reservoir 42, and the elastic region 46 is a part sealing one opening face of the space to be each pressure chamber 40. Besides, an ink introducing opening 34 is so formed as to penetrate the elastic plate 38 to connect between the ink supply passage 33 and the reservoir 42.

The elastic region 46 includes a diaphragm region 48 in which a plurality of movable island portions 47 are formed, and end region 50 provided in both longitudinal ends of the diaphragm region 48. The fixed island portion 49 is formed in each end region 50. The auxiliary fixed island portion 51 is each longitudinal end portion of the diaphragm region 48. The diaphragm region 48 is elongated in the direction of which the vibrators are arranged. As shown in a dashed line in FIG. 3, the size of the diaphragm region 48 is slight smaller than the size of channel unit-side opening 52 of the chamber 14. Each movable island portion 47 is formed by annularly removing the supporting plate 43 so as to elongate in a direction perpendicular to the direction of which the vibrators are arranged. Since the elastic film 44 (i.e., PPS) is insulative, the island portions are insulated from each other.

96 movable island portions 47, that is the same number as the nozzle orifices 39 are formed with a pitch corresponding to the pitch of which the pressure chambers 40 (nozzle orifices 39) are formed. The length of each movable island portion 47 is slight longer than a dimension of the driving vibrator 21 in a direction of which the movable island portion extends. The auxiliary island portions 51 have the same shape as the movable island portions 47. A pitch between the auxiliary island portion 51 and an adjacent movable island portion 47 is the same as the pitch of which the movable island portions 47 are arranged.

Each end region 50 is rectangular region made continuous to the diaphragm region 48. The size of the end region 50 is determined in accordance with the opening 52. Specifically, a short-side width of the end region 50 is so determined that a short-side edge 52*a* of the opening 52 can be placed within the end region 50. In this embodiment, it is determined such that a very narrow gap G is formed between the short-side edge 52*a* and a longitudinal side edge of the end region 50. The longitudinal width of the end region 50 is so determined as to be sufficiently greater than the short-side width of the opening 52. In this embodiment, the longitudinal width is twice the short-side width of the opening 52.

The fixed island portion 49 includes a body part 53 and branch parts 54 extended from the body part 53. Since also the fixed island portion 49 is formed by annularly removing the supporting plate 43, it is insulated from the movable island portions 47 and the auxiliary fixed island portion 51. The body part 53 is constituted by a base 55 extending parallel with the movable island portions 47 and a pair of protrusions 56 perpendicularly extended from both longitudinal ends of the base 55 and directed outward of the supporting plate 43.

As shown in FIG. 7, the end face of each protrusion 56 faces the longitudinal side edge of the end region 50 so as to form a narrow gate 57 therebetween. The word "narrow" means a width enough to hold an adhesive (described later) therein owing to the surface tension of the adhesive. The distance between the protrusions 56 is so determined as to be slight lager than the short-side width of the opening 52.

The branch parts 54 is extended from both longitudinal ends of the base 55. In this embodiment, the branch parts extends parallel with the base 55. The end face of the each branch part 54 faces a short-side edge of the end region 50 so as to form a narrow auxiliary gate 58. A narrow passage 59 is continued from the auxiliary gate 58 toward the diaphragm region 48.

The island portion 49 and the elastic film 44 define an adhesive holding recess in each end region 50. More specifically, the body part 53 defines a main recess 61 opposing to corner portion 52*b* of the opening 52, and the branch part 54 defines an auxiliary recess 62. The main recess 61 and the auxiliary recess 62 are communicated via the gate 57. The auxiliary recess 62 and the diaphragm region 48 are communicated via the auxiliary gate 58 and the narrow passage 59.

The main recess 61 and the auxiliary recess 62 retain an excessive adhesive overflowed from the chamber 14 therein to prevent the adhesive from overflowing to the diaphragm region 48. Details of the adhesive retaining will be described later.

Figure 6:
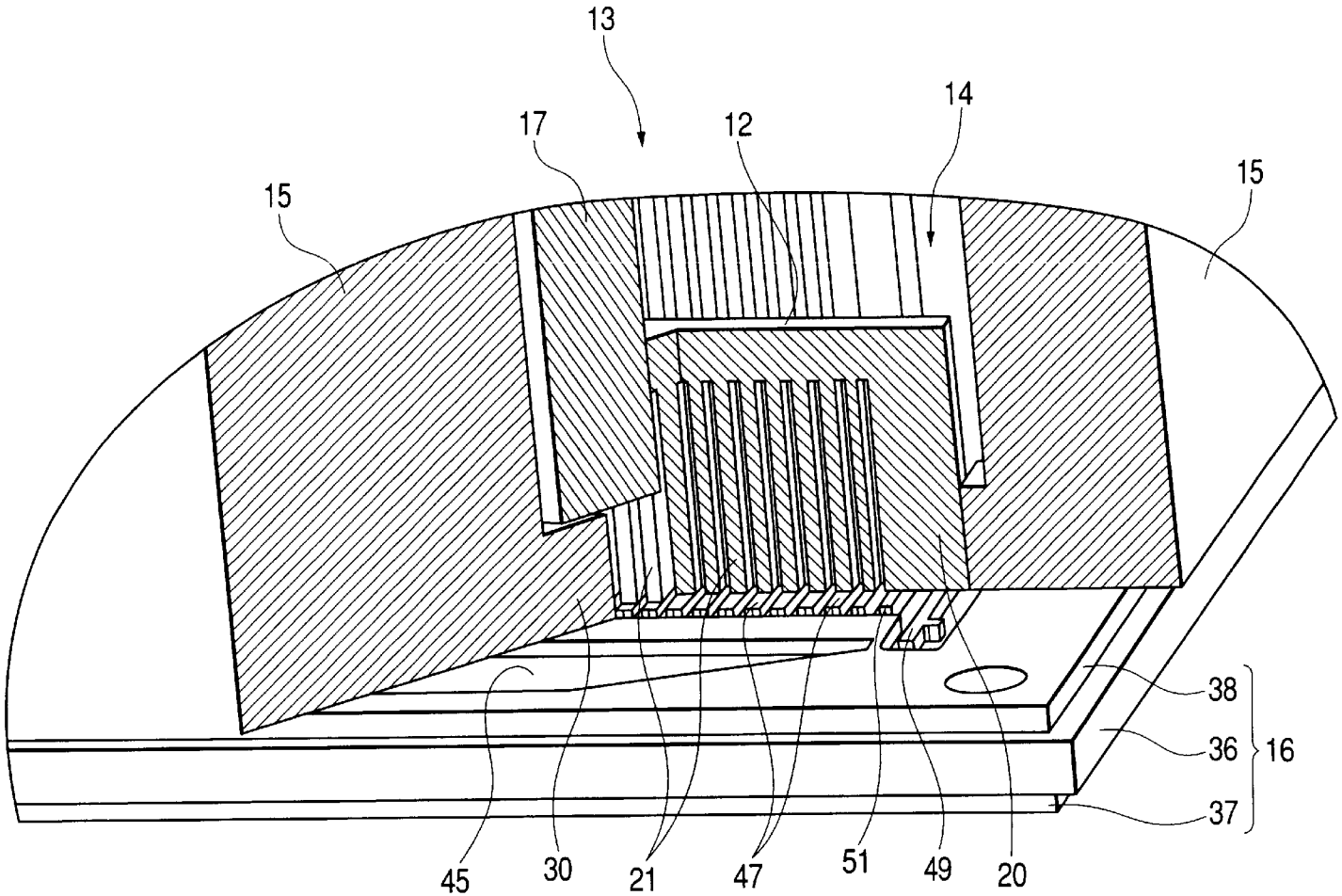
FIG. 6 is a view enlarged at a main part of the liquid jetting head in which a part of the case is cut out.

The vibrator unit 13 is inserted into the chamber 14 from the carriage-side end face of the case 15, in a state that the free end portions of the vibrator assembly 12 are directed to the channel unit 16. When the vibrator unit 13 is then bonded to the chamber 14, as shown in FIGS. 4 to 6, the tip end faces of the drive piezoelectric vibrators 21 are bonded to the respective associated movable island portions 47. When the driving vibrator 21 is expanded or contracted, the elastic film 44 around the associated movable island portion 47 is deformed so that the associated pressure chamber is expanded or contracted.

On the other hand, the tip end face of each dummy vibrator 20 is bonded to the fixed island portion 49 and the auxiliary fixed island portion 51. As described the above, since these island portions are insulated from the other member by the elastic film 44, the bias potential applied to the dummy vibrators 20 will not leak to the supporting plate 43 via the fixed island portion 49 and the auxiliary fixed island portion 51. In addition, as shown in FIG. 6, since the dummy vibrators 20 are separated from the supporting plate 43, the bias potential applied to the dummy vibrators 20 will not directly leak to the supporting plate 43. Furthermore, since the case 15 to which the dummy vibrators 20 contact is made of insulative thermosetting resin such as epoxy resin, the bias potential applied to the dummy vibrators 20 will not leak to the supporting plate 43 via the case 15.

Since the leaking of the bias potential of the dummy vibrators 20 to the supporting plate 43 is structurally prevented, the supporting plate 43 will not charge with the bias potential. Accordingly, the charge of ink via the ink introducing opening 34 can be avoided so that the deviated flight of ink drop due to the ink charging or the fault caused by the short-circuit to the frame ground can be avoided.

Next, the adhesive retaining of the main recess 61 and the auxiliary recess 62 will be described in detail while explaining procedures for bonding the vibrator unit 13.

Prior to the bonding fixation of the vibrator unit 13, the channel unit 16 is first joined to the case 15. For example, an adhesive layer is formed on the channel unit-side end face of the case 15 so that the channel unit 16 which has been separately fabricated is placed on the adhesive layer to be fixed thereon. After then, the vibrator unit 13 is inserted into the chamber 14 in a state that the case 15 is directed such that the channel unit 16 faces downward. The insertion of the vibrator unit 13 is performed in a state that the free end potions of the vibrators 20 and 21 are directed to the channel unit 16, and the both side edges of the fixing plate 17 are fitted into the guide groove 31. The insertion is halted when the tip end faces of the vibrators 20 and 21 are abutted onto the associated island portions 47, 49 and 51.

After that, a liquid adhesive is injected into a gap between a back face of the fixing plate 17 opposite to the face on which the vibrator assembly 12 is mounted and an inner wall face of the chamber 14 opposing to the back face. Specifically, a nozzle of an adhesive injection device is placed at the adhesive injection port 32, to inject a predetermined amount of adhesive. This adhesive is a low-viscous thermosetting adhesive. An epoxy-group adhesive is preferably adopted as the adhesive. After the injection, the case 15 is inversed so that the channel unit 16 faces upward. Accordingly, the injected adhesive extends within the gap between the fixing plate 17 and the case 15 including the gap between the end face 17*a* and the step 30, due to the capillary force.

Here, in a case where the amount of injected adhesive is more than a suitable amount, there is probability that the excess adhesive overflows from the gap. The overflowed adhesive goes along the edge of the chamber 14 to reach the opening 52. If the adhesive is the low-viscous type adhesive, the overflowed adhesive immediately reaches the opening 52 and enters into the main recess 61.

Figure 7A:
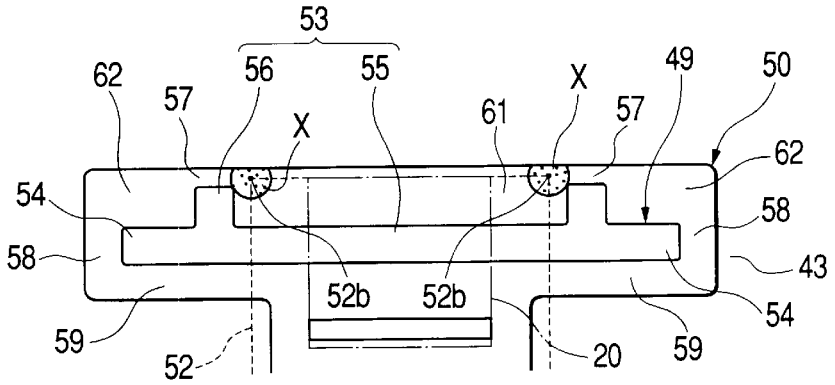
FIGS. 7A to 7D are views describing the states that an adhesive flows in an adhesive holding concave.
Figure 7B:
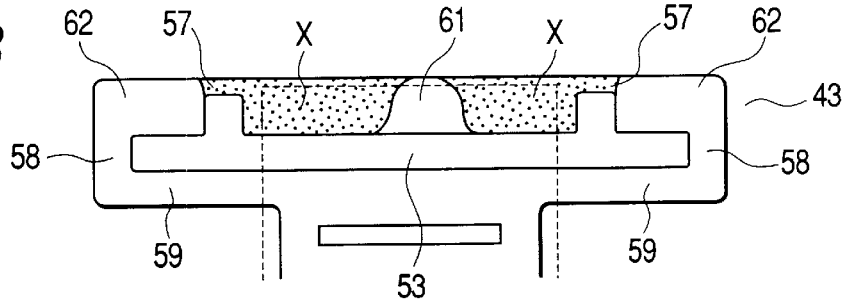

As shown in FIG. 7A, the adhesive X first enters the main recess 61 at portions where oppose to the corners 52*d* of the opening 52. If the overflow of the adhesive X continues, as shown in FIG. 7B, a part of the adhesive X fills the gates 57. The adhesive X entered into the gate 57 is held therein due to the surface tension thereof.

If the overflow of the adhesive X further continues, the adhesive X gradually fills the main recess 61. The adhesive X held in the gate 57 stays thereat until the main recess 61 is completely filled by the overflowed adhesive X. In other words, if the adhesive overflowed from the opening 52 is not more than the capacity of the main recess 61, the adhesive X stays in the main recess 61.

Figure 7C:
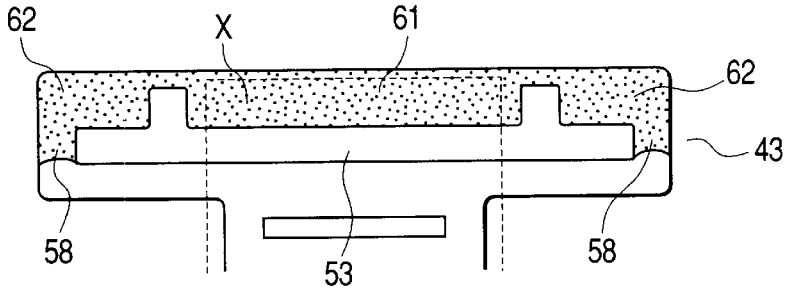

If the overflow of the adhesive X further continues and the overflowed amount exceeds the capacity of the main recess 61, the adhesive X overflows from the main recess 61 to the auxiliary recess 62 through the gate 57. The adhesive X then gradually fills the auxiliary recess 62. As shown in FIG. 7C, when the adhesive X reaches the auxiliary gate 58, it fills the auxiliary gate 58 and held thereat due to the surface tension of the adhesive X.

Figure 7D:
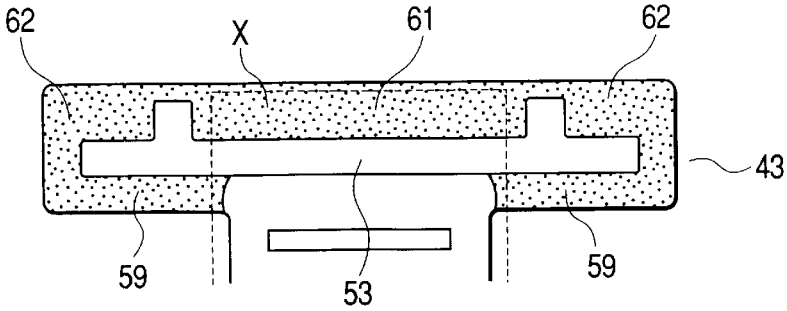
Figure 8:
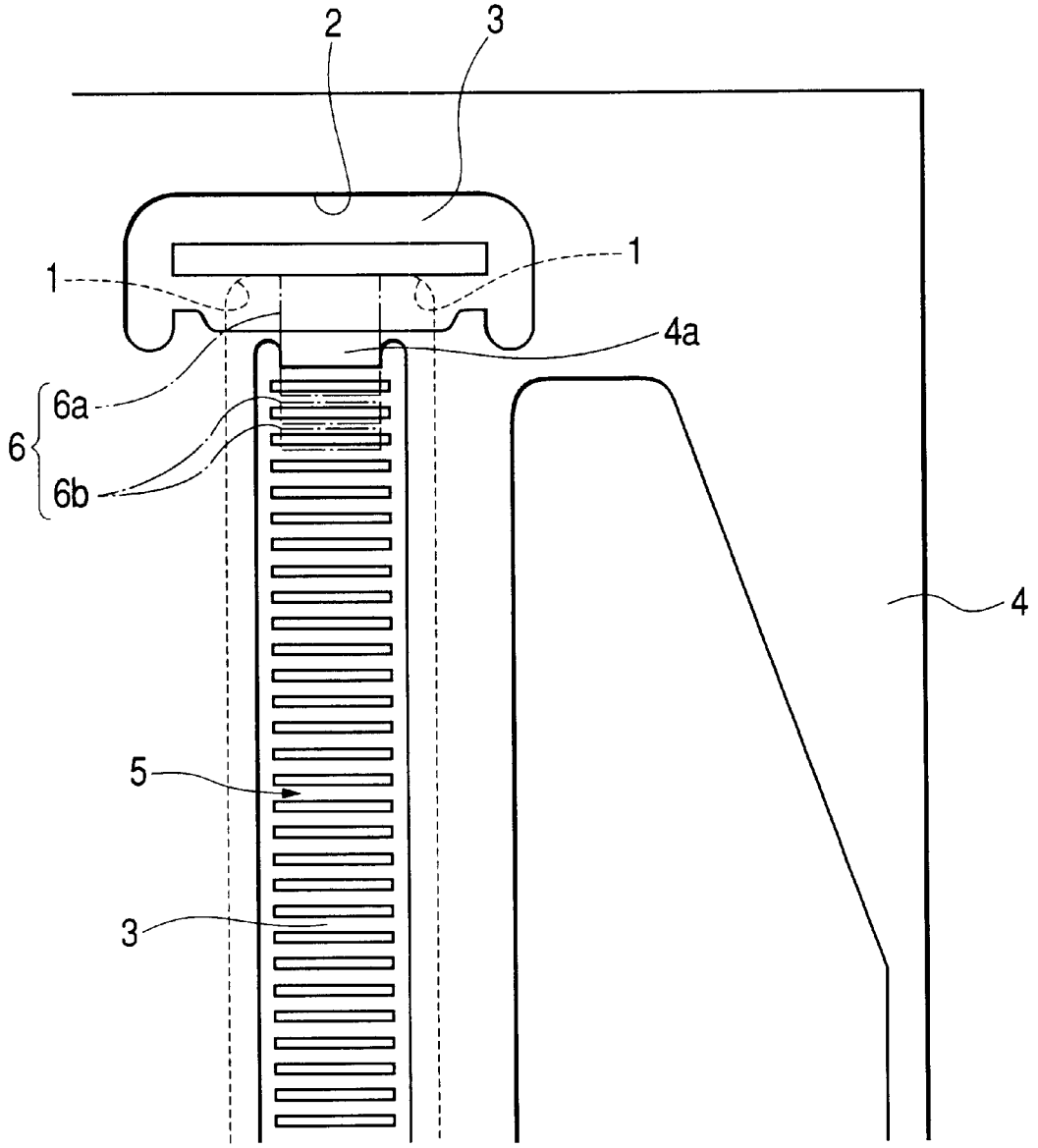
FIG. 8 is a plan view of a related-art liquid jetting head.

If the overflow of the adhesive X further continues in a state that the auxiliary recess 62 has been filled, the adhesive X enters into the passage 59 from the auxiliary gate 58. As shown in FIG. 7D, the adhesive X goes through the passage 59 and held at an exit of the passage 59 due to the surface tension of the adhesive X. The total capacity of the main recess 61, the auxiliary recess 62 and the passage 59 is so determined as to sufficiently receive the excess adhesive. Since the excess adhesive X will not overflow from the passage 59 at most, the invasion of the adhesive X into the diaphragm region 48 can be avoided to maintain the elasticity of the elastic film 44.

The above configurations described with reference to one preferred embodiment can be modified or changed within the scope defined by the appended claims.

For example, the protrusions 56 may be omitted so that the fixed island portion 49 is simply formed into a linear shape.

Second branch parts may be provided to define third recess. The third recess may be communicated with the auxiliary recess 62 via the auxiliary gate 58.

The case 15 may be made of conductive materials such as metals if the fixing plate 17 is made of insulative materials such as ceramics to insulate the vibrator assembly 12 from the case 15. In this case, the alternatives for the material forming the case 15 increase. For instance, materials having high stiffness, which have been difficult to adopt, can be used to fabricate the case 15. Further, if the case 15 is made of conductive materials, the design freedom is improved because the case 15 can be used as a ground electrode.

However, in this case, the electrodes forming the dummy vibrator 20 should be retracted from an outer side face of the vibrator assembly 12, or the dummy vibrator 20 should be placed away from the case 15. In summary, the electrodes forming the dummy vibrator 20 and the case 15 must be insulated.

The descriptions have been made for the ink jet recording head as an example of the liquid jetting head. The present invention is applicable to any other liquid jetting heads. For example, it is applicable for a coloring material jetting head and an electrode material jetting head used for manufacturing a liquid crystal display, an EL display, an FED (field emission display), and so on. It is applicable for a bio-organic substance jetting head used for manufacturing a bio-chip, and for a micro pipette (a sample jetting head).

What is claimed is:

1. A liquid jetting head, comprising:

an elastic plate, including an elastic film and a conductive supporting plate laminated on the elastic film, the conductive supporting plate being partly removed to form an elastic region in which first island portions and second island portions are remained on the elastic film while being electrically insulated from each other;

a head case, formed with a chamber which forms an opening at a first end face joined to the supporting plate; and a vibrator unit, in which a plurality of piezoelectric vibrators are arranged on a fixing plate, the piezoelectric vibrators including a pair of non-deformable vibrators and deformable vibrators arranged between the non-deformable vibrators, wherein:

the vibrator unit is accommodated within the chamber such that each tip end face of the deformable vibrators is abutted onto one of the first island portions, and each tip end face of the non-deformable vibrators is abutted onto one of the second island portions; and each of the second island portions define a first recess at a portion of the elastic region where opposes to corners of the opening at the first end face of the head case, to receive an adhesive used to bond the vibrator unit to the head case and overflowed from the opening.

2. The liquid jetting head as set forth in claim 1, wherein:

a first gap is formed between an edge of the elastic region and each of the second island portions; and a width of the first gap is so determined that the adhesive is held therein due to surface tension of the adhesive.

3. The liquid jetting head as set forth in claim 2, wherein:

each of the second island portions includes a branch part which defines a second recess communicated with the first recess via the first gap;

a second gap is formed between the edge of the elastic region and the branch part; and a width of the second gap is so determined that the adhesive is held therein due to surface tension of the adhesive.

4. The liquid jetting head as set forth in claim 1, wherein the supporting plate is comprised of a stainless steel plate.

5. The liquid jetting head as set forth in claim 4, wherein the head case is comprised of an insulative material.

6. The liquid jetting head as set forth in claim 1, wherein the fixing plate is comprised of an insulative material, and the head case is comprised of a conductive material.

* * * * *